US007361041B2

(12) United States Patent
Hashiguchi et al.

(10) Patent No.: US 7,361,041 B2
(45) Date of Patent: Apr. 22, 2008

(54) CONNECTOR IMPROVED IN FLOATING FUNCTION

(75) Inventors: Osamu Hashiguchi, Tokyo (JP); Kouji Nakada, Tokyo (JP); Yasukazu Itou, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/701,447

(22) Filed: Feb. 1, 2007

(65) Prior Publication Data

US 2007/0178740 A1 Aug. 2, 2007

(30) Foreign Application Priority Data

Feb. 1, 2006 (JP) ..... 2006-025126

(51) Int. Cl.
*H01R 13/64* (2006.01)

(52) U.S. Cl. ..... 439/247

(58) Field of Classification Search ..... 439/352, 439/247, 66, 378, 482, 86, 91, 74, 65, 71, 439/73, 264, 266, 330, 157, 159, 630
See application file for complete search history.

(56) References Cited

U.S. PATENT DOCUMENTS 4,846,703 A * 7/1989 Matsuoka et al. ..... 439/71
5,092,774 A * 3/1992 Milan ..... 439/66
6,139,346 A 10/2000 Cecil, Jr. et al.
2006/0035500 A1* 2/2006 Sugita et al. ..... 439/247
2006/0216980 A1* 9/2006 Lewis ..... 439/247

FOREIGN PATENT DOCUMENTS

JP 2000-348829 12/2000

* cited by examiner

*Primary Examiner*—Edwin A. Leon
(74) *Attorney, Agent, or Firm*—Collard & Roe, P.C.

(57) ABSTRACT

In a connector to be coupled to a housing and for coupling a mating connector in a predetermined direction, a connector element is held by a sub module which is held by the housing to be slidable in the predetermined direction. The sub module includes a floating spring portion. The floating spring portion includes a contacting portion for being brought into contact with the housing and an operated portion connected to the contacting portion. Responsive to movement of the mating connector in the predetermined direction, the operated portion separates the contacting portion from the housing.

8 Claims, 17 Drawing Sheets

CONNECTOR IMPROVED IN FLOATING FUNCTION

This application claims priority to prior Japanese patent application JP 2006-25126, the disclosure of which is incorporated herein by reference.

BACKGROUND OF THE INVENTION

This invention relates to a connector and, in particular, to a connector (hereinafter called a "floating connector") capable of performing floating movement (free movement) in a connector fitting direction and in a direction perpendicular to the connector fitting direction.

FIGS. 1 and 2 show an existing floating connector.

Referring to FIG. 1, a female connector 20 is disposed in a housing 60 and supported by a pair of floating spring portions 101. A reference numeral 80 represents a cap. In case where the floating spring portions 101 are set to be hard, the female connector 20 can be excellently positioned with respect to a male connector 51 upon fitting. However, a reactive force of the hard floating spring portions 101 continuously applies a load upon the housing 60.

If the floating spring portions 101 are set to be soft as illustrated in FIG. 2, the load applied upon the housing 60 is reduced. However, a positioning error tends to occur upon fitting the male and the female connectors 51 and 20. This brings about a trouble in fitting.

Japanese Unexamined Patent Application Publication (JP-A) No. 2000-348829 discloses a floating connector apparatus comprising a first connector, a second connector, unlatching means, and resetting means.

FIG. 3 shows a state where the second connector 118 disclosed in JP 2000-348829 A is going to be fitted to the first connector 116 in a direction depicted by an arrow C. FIG. 4 shows a state where the second connector 118 is completely fitted to the first connector 116. FIG. 5 shows a state where the second connector 118 further moves towards the first connector 116 in the direction depicted by the arrow C.

Referring to FIG. 3, in the floating connector apparatus 110, the unlatching means 146 comprises a triangular stopper boss 148 disposed between the first connector 116 and an adapter 114, integrally formed with the first connector 116, and protruding from both of upper and lower surfaces of the first connector 116. The stopper boss 148 moves between a pair of stopper surfaces 152 formed on distal inner ends of a pair of unlatching arms 154, respectively.

Herein, the magnitude of a force required to push the stopper boss 148 over the stopper surfaces 152 under a bending force of the arms 154 is determined by an angle of a pair of stopper surfaces 150 of the stopper boss 148. The angle is an angle such that a force greater than a fitting force of the first and the second connectors 116 and 118 is required in order to move the stopper boss 148 over the stopper surfaces 152 of the arms 154. Therefore, the first and the second connectors 116 and 118 are fitted to each other before the first connector 116 can perform floating movement with respect to the adapter 114.

The latching/unlatching means 146 is formed so that the first connector 116 is latched against the floating movement in a fitting direction and that the second connector 118 can be fitted to the first connector 116 with a predetermined fitting force without the floating movement.

When the first and the second connectors 116 and 118 are fitted to each other, the latching/unlatching means 146 unlatches latching of the first connector 116 in response to a force greater than the fitting force. As a result, the first and the second connectors 116 and 118 fitted to each other are allowed to perform the floating movement in an axial direction with respect to the adapter 114 and the panel.

On the other hand, the resetting means is disposed between the first connector 116 and the adapter 114 in order to reset the unlatching means 146 in response to a resetting force smaller than a fitting releasing force given to the second connector 118 in a fitting releasing direction (opposite to the arrow C in FIG. 4). The resetting means is formed simply by shaping the boss 148 into a diamond shape to form a pair of stopper surfaces 160 faced to a direction opposite to the stopper surfaces 150.

Next, description will be made of an operation of the connector apparatus illustrated in FIGS. 3 to 5.

Referring to FIG. 3, in the state before the second connector 118 is fitted to the first connector 116 in the direction depicted by the arrow C, a locking member is engaged with a front part of a locking hole. Therefore, the first connector 116 can not move frontward. In addition, since the boss 148 is engaged with the stopper surfaces 152 of the arms 154, the connector 116 can not move rearward also. Therefore, the first connector 116 does not float.

Referring to FIG. 4, in the state where the second connector 118 is completely fitted to the first connector 118, the triangular boss 148 of the unlatching means 146 does not move over the stopper surfaces 152 of the arms 154. The force required to move the boss 148 over the stopper surfaces 152 is greater than the fitting force between the first and the second connectors 116 and 118 so that the first connector 116 is not yet allowed to perform the floating movement.

Referring to FIG. 5, in the state where the second connector 118 further moves towards the first connector 116 in the direction depicted by the arrow C, a force greater than the fitting force is applied to the second connector 118 and the triangular boss 148 of the first connector 116 moves over the stopper surfaces 152 of the arms 154 of the adapter 114. Consequently, the first and the second connectors 116 and 118 fitted to each other are allowed to perform floating movement in the fitting direction with respect to the adapter 114 and the panel within a range defined by the locking member 130 located in the locking hole 128 of the adapter 114 to lock the first connector 116.

As is obvious from FIGS. 3 to 5, the stopper surfaces 160 of the resetting means form an angle smaller than that formed by the stopper surfaces 150 in the fitting and the fitting releasing directions. In this state, the boss 148 can be returned outward over the stopper surfaces 152 of the arms 154 with a force smaller than the fitting releasing (fitting) force. Therefore, when the fitting releasing force is applied to the second connector 118 in a direction opposite to the arrow C in FIG. 5, the boss 148 returns to a position illustrated in FIG. 4 outward from the stopper surfaces 152 of the arms 154 without releasing the second connector 118 from the first connector 116.

Then, the first and the second connectors 116 and 118 can be completely released from each other as shown in FIG. 3. The first connector 116 is no longer allowed to perform floating movement in the fitting direction.

The above-mentioned connector apparatus 110 is disadvantageous in that, even in case where a designed maximum number of contacts are not used, for example, in case where the connector apparatus 110 is used with only 60 contacts inserted in a housing designed for 100 contacts, a fitting force for the maximum number of contacts is required.

SUMMARY OF THE INVENTION

It is therefore an object of this invention to provide a floating connector improved in floating function.

It is another object of this invention to provide a floating connector capable of preventing a positioning error of a level such that a trouble is caused in fitting.

It is still another object of this invention to provide a floating connector capable of reducing a load imposed upon a housing by a floating spring portion.

It is yet another object of this invention to provide a connector in which the connector and a mating connector fitted to each other are locked at a fitting distance assuring an excellent relationship therebetween so that fitting is completed with a fitting force corresponding to the number of contacts and a floating state is started.

Other objects of the present invention will become clear as the description proceeds.

According to an aspect of the present invention, there is provided a connector to be coupled to a housing and for coupling a mating connector in a predetermined direction, the connector comprising a sub module to be held by the housing and a connector element held by the sub module to be slidable in the predetermined direction, the sub module comprising a floating spring portion, the floating spring portion comprising a contacting portion for being brought into contact with the housing and an operated portion connected to the contacting portion and responsive to movement of the mating connector in the predetermined direction for separating the contacting portion from the housing.

DESCRIPTION OF THE PREFERRED EMBODIMENTS

Figure 1:
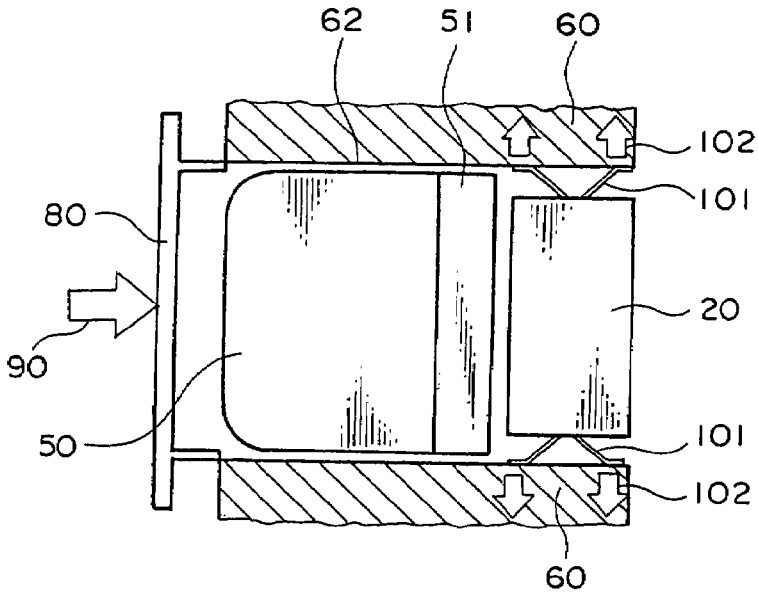
FIG. 1 (Prior Art)
FIG. 1 is a schematic plan view of an existing floating connector.
Figure 2:
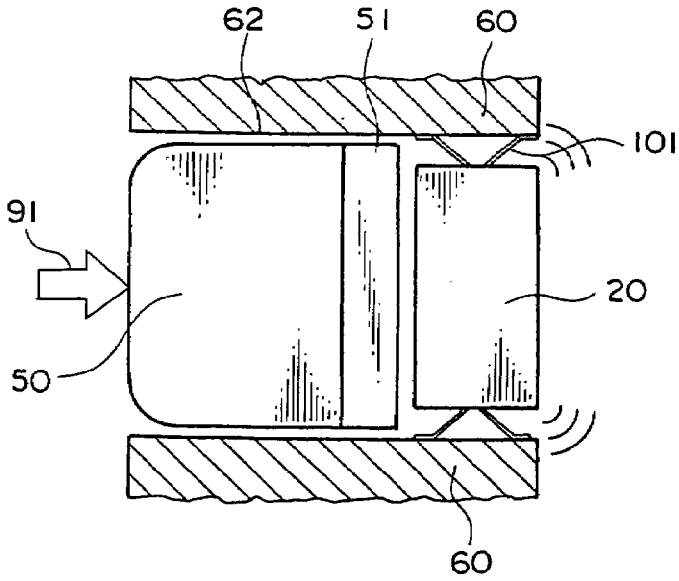
FIG. 2 (Prior Art)
FIG. 2 is a schematic plan view of another existing floating connector.
Figure 3:
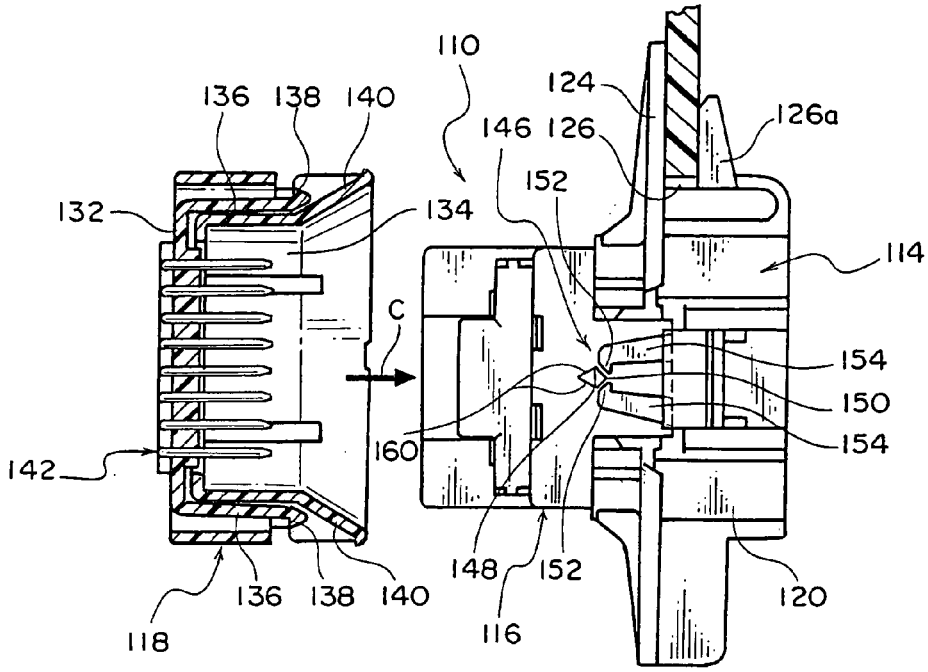
FIG. 3 (Prior Art)
FIG. 3 is a view showing an existing floating connector apparatus in a state before a first connector and a second connector are fitted to each other.
Figure 4:
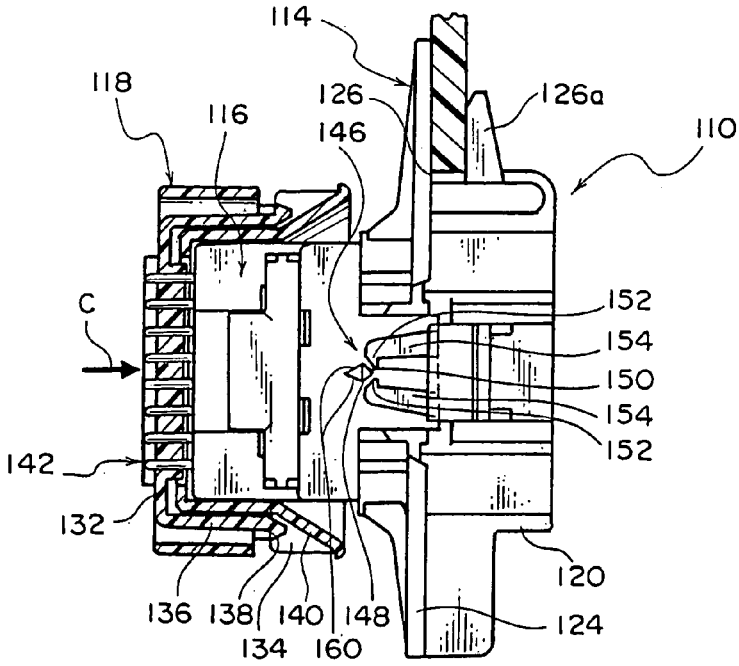
FIG. 4 (Prior Art)
FIG. 4 is a view showing the existing floating connector apparatus in FIG. 3 in a state where the second connector is completely fitted to the first connector.
Figure 5:
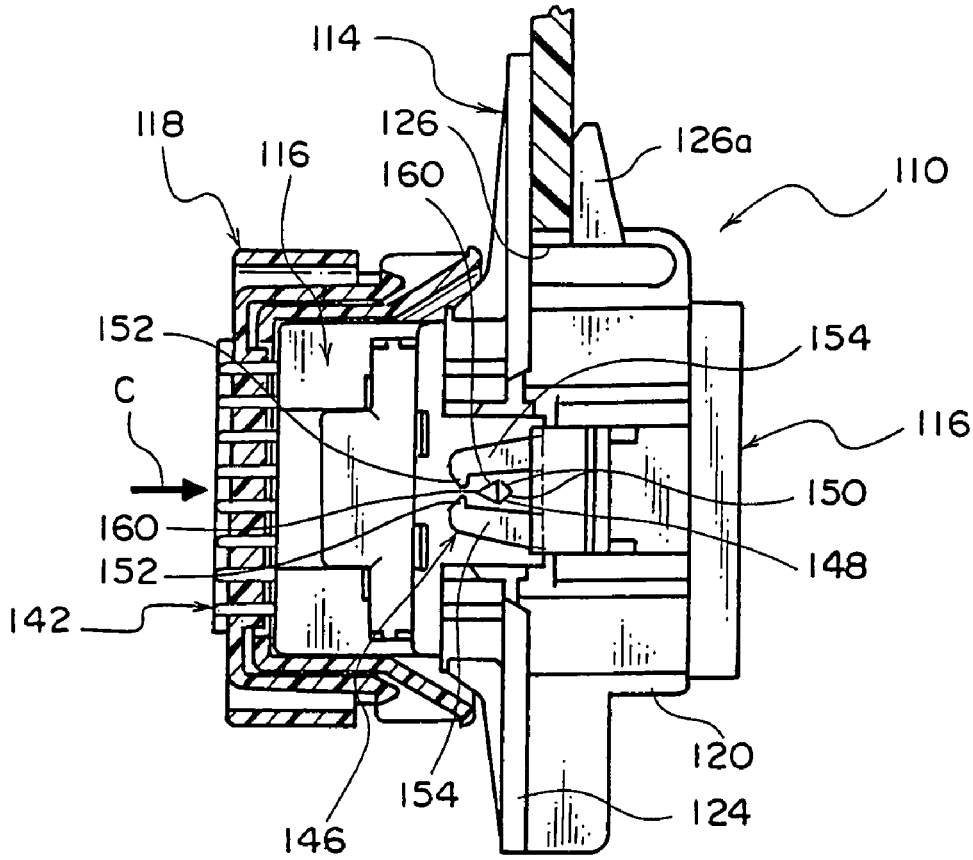
FIG. 5 (Prior Art)
FIG. 5 is a view showing the existing floating connector apparatus in FIG. 3 in a state where the second connector further moves towards the first connector in a fitting direction.

Now, description will be made of a few embodiments of this invention with reference to the drawing. In the following, description is directed to a floating connector equipped in an ECU (Electronic Control Unit)-BOX mounted to an automobile or the like. However, it will readily be understood that this invention is not limited to the floating connector used in the ECU-BOX of the automobile or the like.

Figure 6:
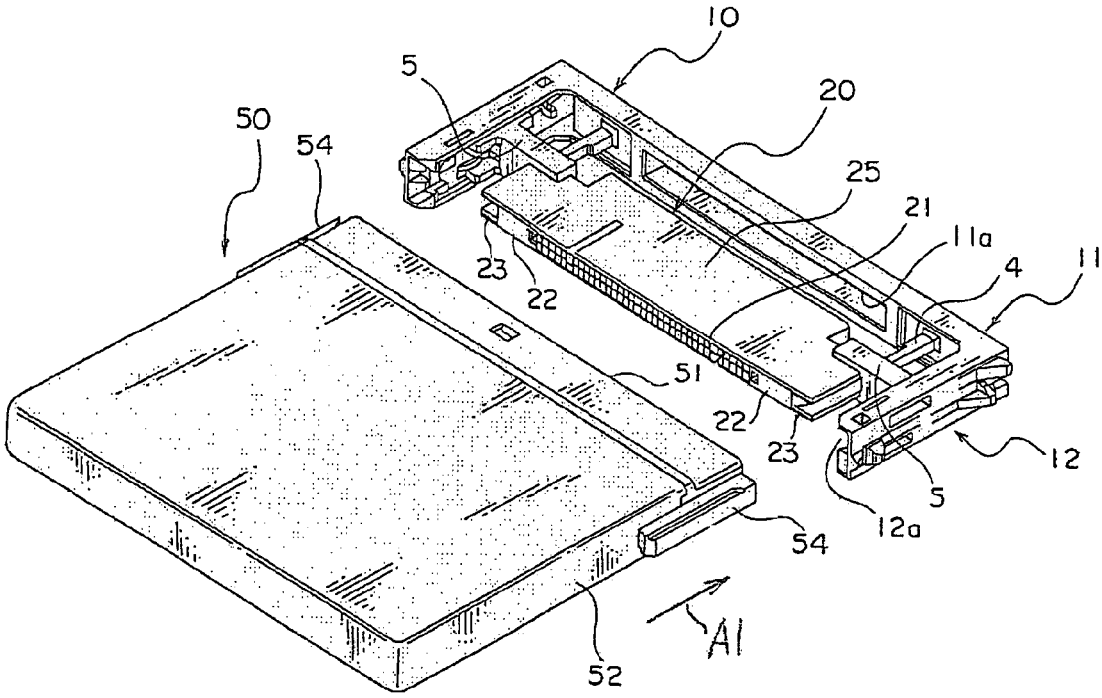
FIG. 6 is an exploded perspective view of a floating connector according to a first embodiment of this invention.

Referring to FIG. 6, the floating connector comprises a sub module 10 provided with a female connector 20. The sub module 10 comprises a base portion 11 and a pair of guide portions 12 formed on opposite sides of the base portion 11 and extending frontward in a connector fitting direction or a predetermined direction A1. The base portion 11 has a hole 11*a* allowing a cable (not shown) to be inserted into a cable slot (not shown) formed on a rear side of the female connector 20 and to be connected to a plurality of contacts of the female connector 20.

The female connector 20 has a fitting portion 21 provided with the contacts disposed in a plurality of holes formed on a female housing 25 in upper and lower rows, a pair of contacting portions 22 formed on opposite sides of the fitting portion 21, and a pair of guide grooves 23 formed outside the contacting portions 22. On opposite sides of the female housing 25, a pair of sliding portions 5 slidable and movable in the fitting direction together with the female housing 25 are formed.

To the fitting portion 21 of the female connector 20, a male connector 51 is fitted. The male connector 51 is disposed on one end of an ECU case 52 of an electronic apparatus 50 as a mating connection object and has a pair of guide portions 54 formed on opposite sides of the male connector 51.

Figure 7:
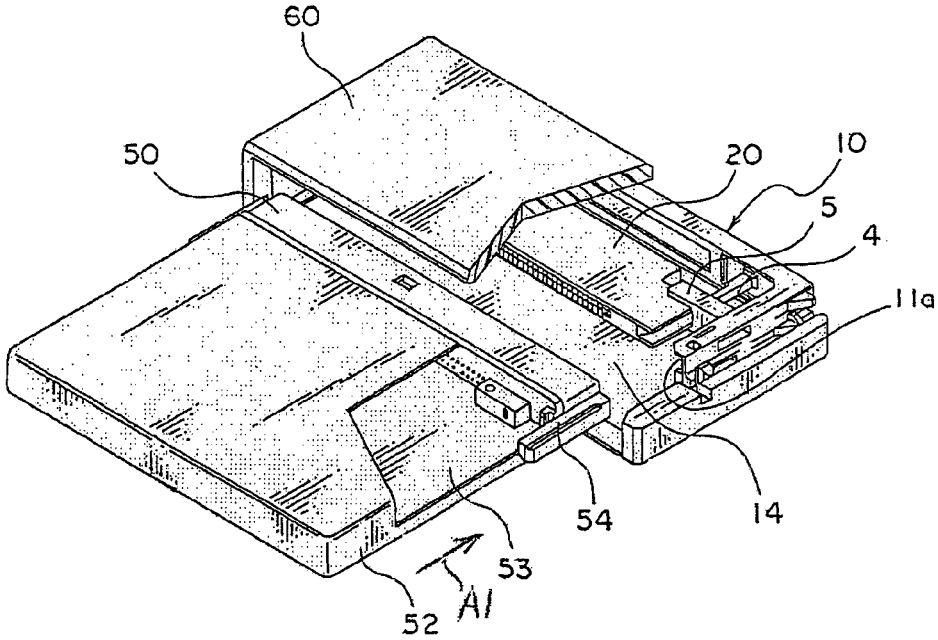
FIG. 7 is a partially-cutaway perspective view of the floating connector in FIG. 6 in a state where a sub module is mounted to a housing of the connector.

Referring to FIG. 7, the sub module 10 is disposed in a housing 60 called an ECU-BOX.

The mating electronic apparatus 50 is disposed in the ECU case 52 receiving a substrate 53 called an ECU board. The male connector 51 is attached to one end of the substrate 53 and seals one end of the ECU case 52.

Figure 8:
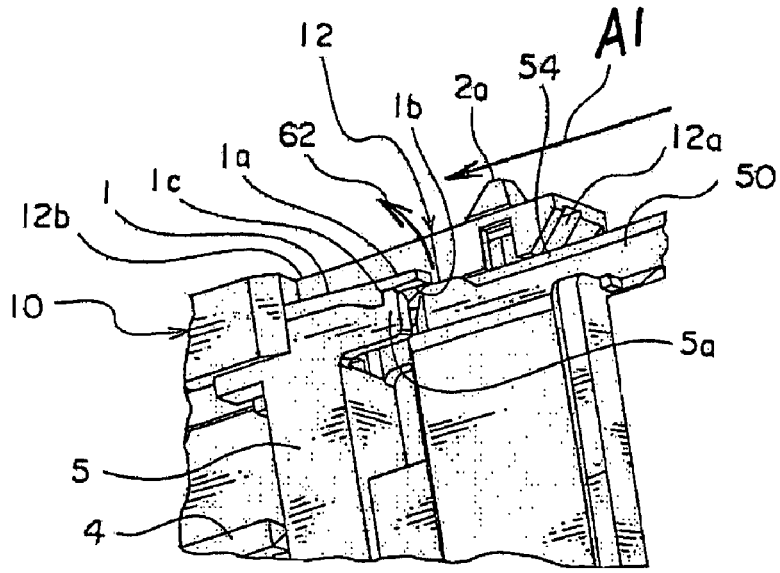
FIG. 8 is a partial perspective view showing a fitting direction floating spring portion of the sub module in FIG. 7.

Referring to FIG. 8 in addition, inside each of the guide portions 12 of the sub module 10, the sliding portion 5 of a T shape extends from the female housing 25 of the female connector 20 towards an inner wall of the guide portion 12. Outside the sliding portions 5, fitting direction floating spring portions 1 having free ends bent outward in a horizontal direction are formed. Each of the fitting floating spring portions 1 has a fitting-side end 1*a*, a triangular protrusion 1*b* formed inside the fitting-side end 1*a* and having a slant surface inclined frontward in the fitting direction, and an engaging portion 1*c* formed at a rear side and protruding inward.

Upon fitting, the protrusions 1*b* are pushed by the guide portions 54 on opposite sides of the male connector 51. As a result, the floating spring portions 1 are widened outward.

Normally, the engaging portions 1*c* are engaged with protruding portions 5*a* of the sliding portions 5 to be prevented from rearward movement. When the fitting floating spring portions 1 are displaced to be widened outward during fitting, the engagement is released so that the fitting floating spring portions 1 are slidable rearward. A reference numeral 4 represents a guide rod for guiding rearward movement of the female housing 25.

Figure 9:
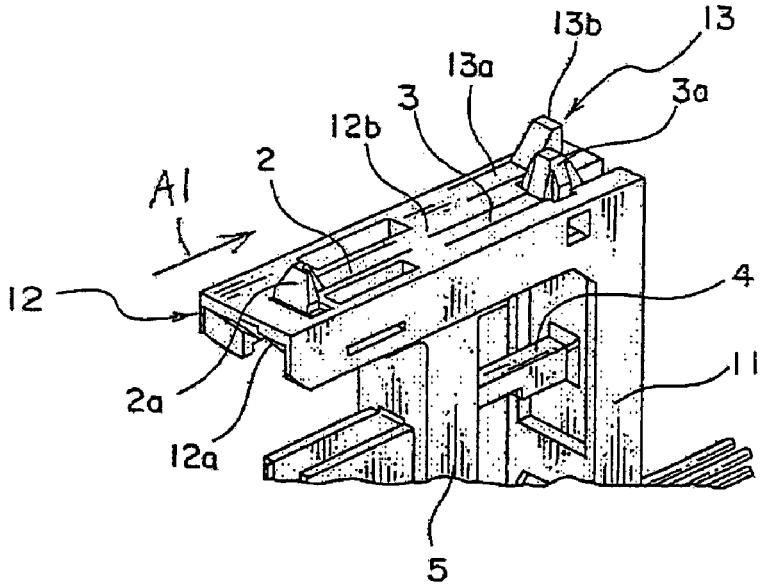
FIG. 9 is a partial perspective view showing a horizontal/vertical direction floating spring portion of the sub module in FIG. 7.

Referring to FIG. 9, each of the guide portions 12 is provided with a locking portion 13 formed on its rear side. The locking portion 13 comprises a leaf spring portion 13*a* and a generally wedge-like protrusion 13*b* which is formed at an end portion of the leaf spring portion 13*a* to be attached to the housing 60. The guide portion 12 is provided with first and second horizontal/vertical direction floating spring portions 2 and 3 formed on its front side. The first horizontal/vertical direction floating spring portion 2 has a protruding portion 2*a* integrally formed with a wall portion of the guide portion 12. The first horizontal/vertical direction floating spring portion 2 has one end formed at the center of the guide portion 12 as a supporting portion 12*b*, extends from the one end towards the other end in the fitting direction to cut the guide portion 12, and protrudes outward at the other end as the protruding portion 2*a* in a generally truncated pyramidal shape. The second horizontal/vertical direction floating spring portion 3 similarly has a protruding portion 3*a* formed integral with the guide portion 12. The second horizontal/vertical direction floating spring portion 3 has one end formed at the center of the guide portion 12 as the supporting portion 12*b*, extends from the one end towards the other end rearward in the fitting direction to cut the guide portion 12, and protrudes outward at the other end as the protruding portion 3*a* in a generally truncated pyramidal shape. The first and the second horizontal/vertical direction floating spring portions 2 and 3 have base portions shifted in position from each other.

Next, description will be made of an operation of the floating connector described in conjunction with FIGS. 6 to 9.

Figure 10:
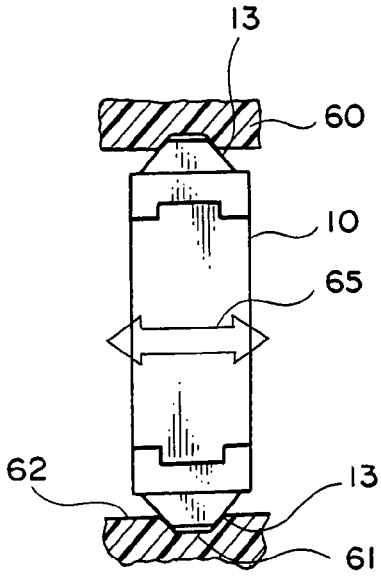
FIG. 10 is a view showing the housing as seen from a fitting direction.

As shown in FIG. 10, the sub module 10 is supported by an inner wall 62 of the housing 60. Specifically, the sub module 10 is supported by recessed portions 61 formed on the inner wall 62 via the locking portions 13 protruding outward from the sub module 10. The sub module 10 is allowed to perform floating movement in a direction depicted by an arrow 65, i.e., in a thickness direction of the connector.

Figure 11:
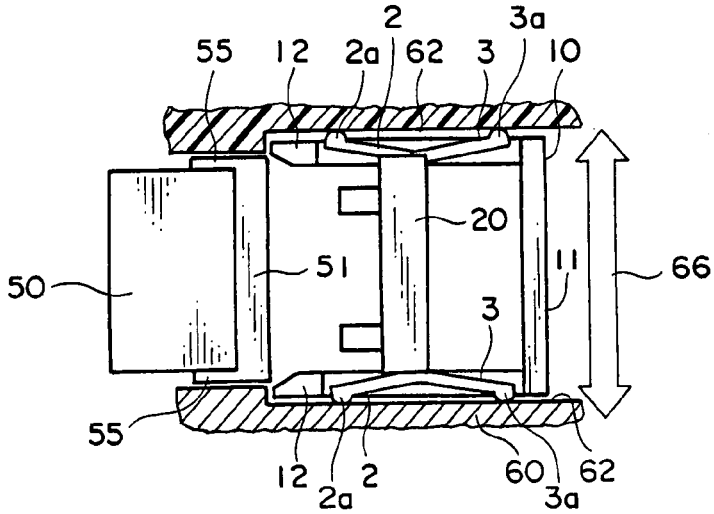
FIG. 11 is a schematic plan view for describing a floating structure of the connector received in the housing in FIG. 6, where the housing is shown in section.

Referring to FIG. 11, the mating electronic apparatus 50 is inserted into the housing 60 from the side of the male connector 51 so that the male connector 51 is fitted to the female connector 20. Before and while the male connector 51 is fitted to the female connector 20, the protruding portions 2*a* and 3*a* at the ends of the first and the second horizontal/vertical direction floating spring portions 2 and 3 on left and right sides are brought into contact with the inner wall 62 of the housing 60. Therefore, in presence of a reactive force of the first and the second horizontal/vertical direction floating spring portions 2 and 3, the female connector 20 is allowed to perform floating movement in a direction depicted by an arrow 66, i.e., in a widthwise direction of the connector.

Figure 12:
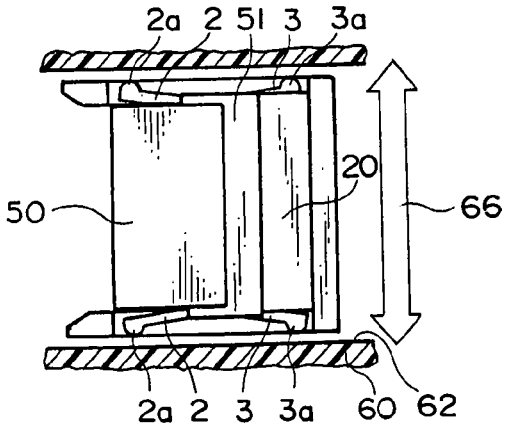
FIG. 12 is a schematic plan view similar to FIG. 11.

Referring to FIG. 12, after the male connector 51 of the mating electronic apparatus 50 is fitted to the female connector 20 in the housing 60, operated portions of the first horizontal/vertical direction floating spring portion is engaged with an end portion of the guide portions 54 of the male connector 51 illustrated in FIGS. 6 and 7, so that the protruding portions 2*a* and 3*a* formed at the ends of the first and the second horizontal/vertical direction floating spring portions 2 and 3 on the left and the right sides are retreated inward and separated from the inner wall 62 of the housing 60. Therefore, without being applied with the reactive force of the first and the second horizontal/vertical direction floating spring portions 2 and 3, the mating electronic apparatus 50 is allowed to perform floating movement in the direction depicted by the arrow 66, i.e., in the widthwise direction of the connector.

Figure 13:
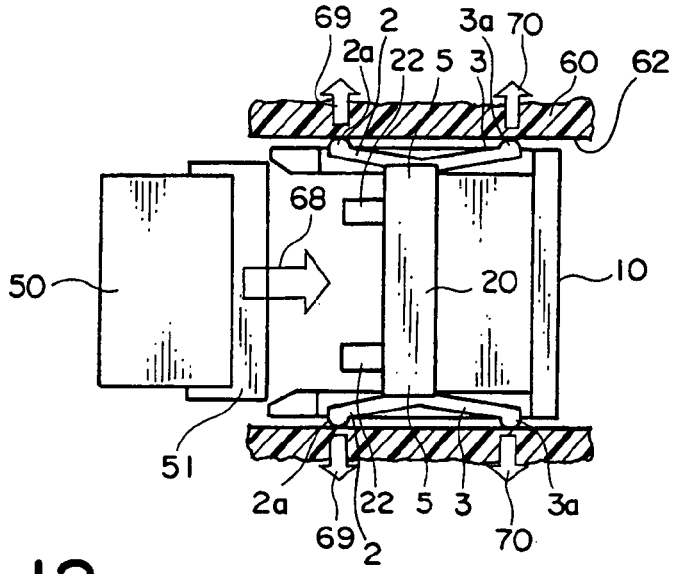
FIG. 13 is a plan view for describing a fitting operation.

Referring to FIG. 13, before and while the male connector 51 and the female connector 20 are fitted to each other, the protruding portions 2*a* and 3*a* at the ends of the first and the second horizontal/vertical direction floating spring portions 2 and 3 are brought into contact with the inner wall 62 of the housing 60. Therefore, in presence of the reactive force of the first and the second horizontal/vertical direction floating spring portions 2 and 3 as depicted by arrows 69 and 70, the female connector 20 is allowed to perform floating movement in the widthwise direction of the connector.

Figure 14:
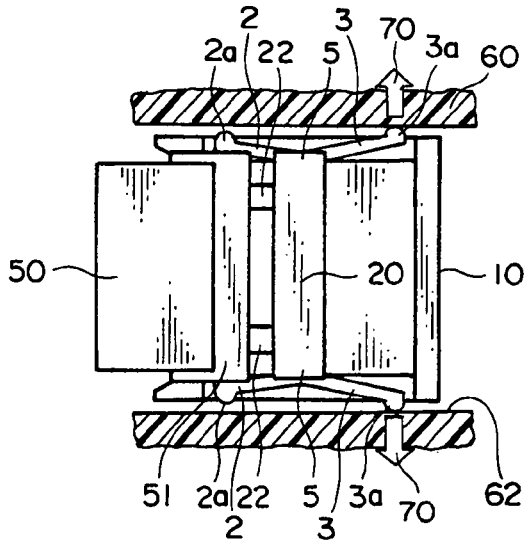
FIG. 14 is a plan view similar to FIG. 13.

Referring to FIG. 14, in the state during fitting, a first floating releasing operation is performed. The first horizontal/vertical direction floating spring portion 2 is retreated inward following the movement of the male connector 51. On the other hand, the second horizontal/vertical direction floating spring portion 3 is kept as it is and the reactive force is kept applied as depicted by the arrow 70.

Figure 15:
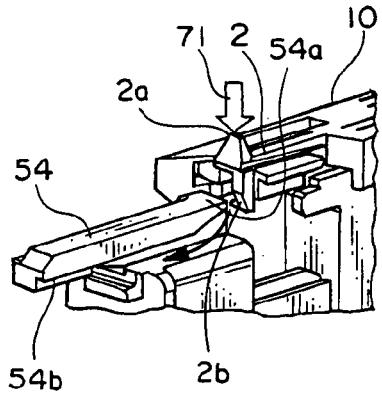
FIG. 15 is a partial perspective view for describing the fitting operation.

Referring to FIG. 15 in addition, the first floating releasing operation will be described in detail. Each of the guide portions 54 on lateral sides of the male connector 51 has a wedge-like end portion 54*a* and a groove 54*b* extending rearward from the end portion 54*a*. This part is engaged with a boss portion 2*b* as an operated portion formed inside the protruding portion 2*a* of the first horizontal/vertical direction floating spring portion 2 and protruding in a L shape. Following advancing movement of the male connector 51, the boss portion 2*b* is drawn towards the male connector 51 along the groove 54*b*. Therefore, the first horizontal/vertical direction floating spring portion 2 is displaced inward in the widthwise direction and is released from the state where the protruding portion 2*a* is brought into contact with the inner wall 62 of the housing 60. Thus, the first floating releasing operation is performed.

Figure 16:
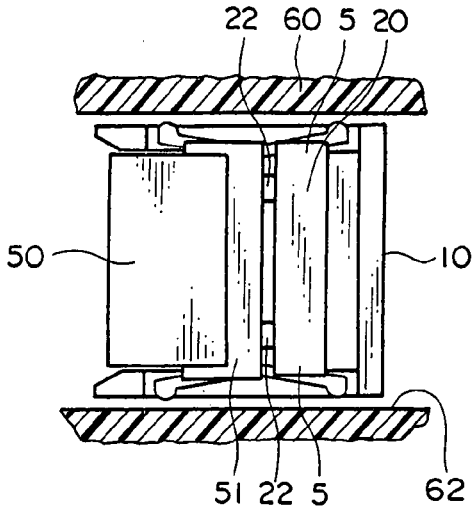
FIG. 16 is a plan view similar to FIG. 13.

Referring to FIG. 16, in the state where the female connector 20 is retreated or moved rearward during fitting, the second horizontal/vertical direction floating spring portion 3 is drawn inward following the movement of the male connector 51. Thus, a second floating releasing operation is performed.

Figure 17:
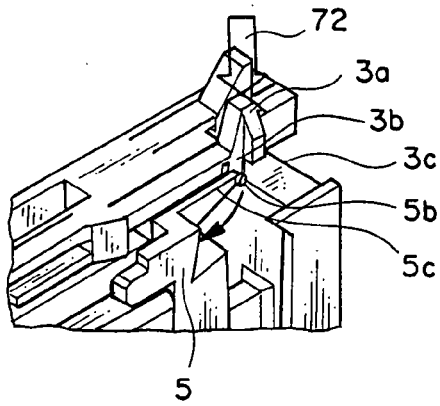
FIG. 17 is a partial perspective view for describing the fitting operation.

Referring to FIG. 17 in addition, the second floating releasing operation will be described in detail. When the male connector 51 further advances, the female connector 20 is retreated or moved rearward. In the female connector 20, each of the sliding portions 5 has opposite rear ends 5*b* in a wedge-like shape which form an operating portion, and a guide groove 5*c* continuous therefrom and extending frontward. This part is engaged with a boss portion 3*b* as an operated portion formed inside the protruding portion 3*a* of the second horizontal/vertical direction floating spring portion 3 and protruding in a L shape. Following advancing movement of the male connector 51, the sliding portion 5 is retreated, moves in the guide groove 5*c*, and is drawn inward. Therefore, the second horizontal/vertical direction floating spring portion 3 is displaced inward and is released from the state where the protruding portion 3*a* is brought into contact with the inner wall 62 of the housing 60. Thus, the second and restrained floating releasing operation is performed under the spring reactive force.

Figure 18:
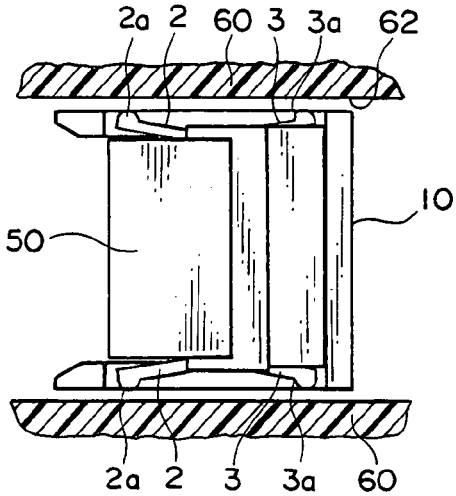
FIG. 18 is a plan view similar to FIG. 13.

Referring to FIG. 18, in the state after fitting, the protruding portions 2*a* and 3*a* at the ends of the first and the second horizontal/vertical direction floating spring portions 2 and 3 on left and right sides are retreated inward and separated from the inner wall 62 of the housing 60 as described above. Therefore, floating movement is possible in a state where the reactive force of the first and the second horizontal/vertical direction floating spring portions 2 and 3 is not applied.

Next referring to FIGS. 19 to 31, description will be made of a floating connector according to a second embodiment of this invention. Similar parts are designated by like reference numerals.

Figure 19:
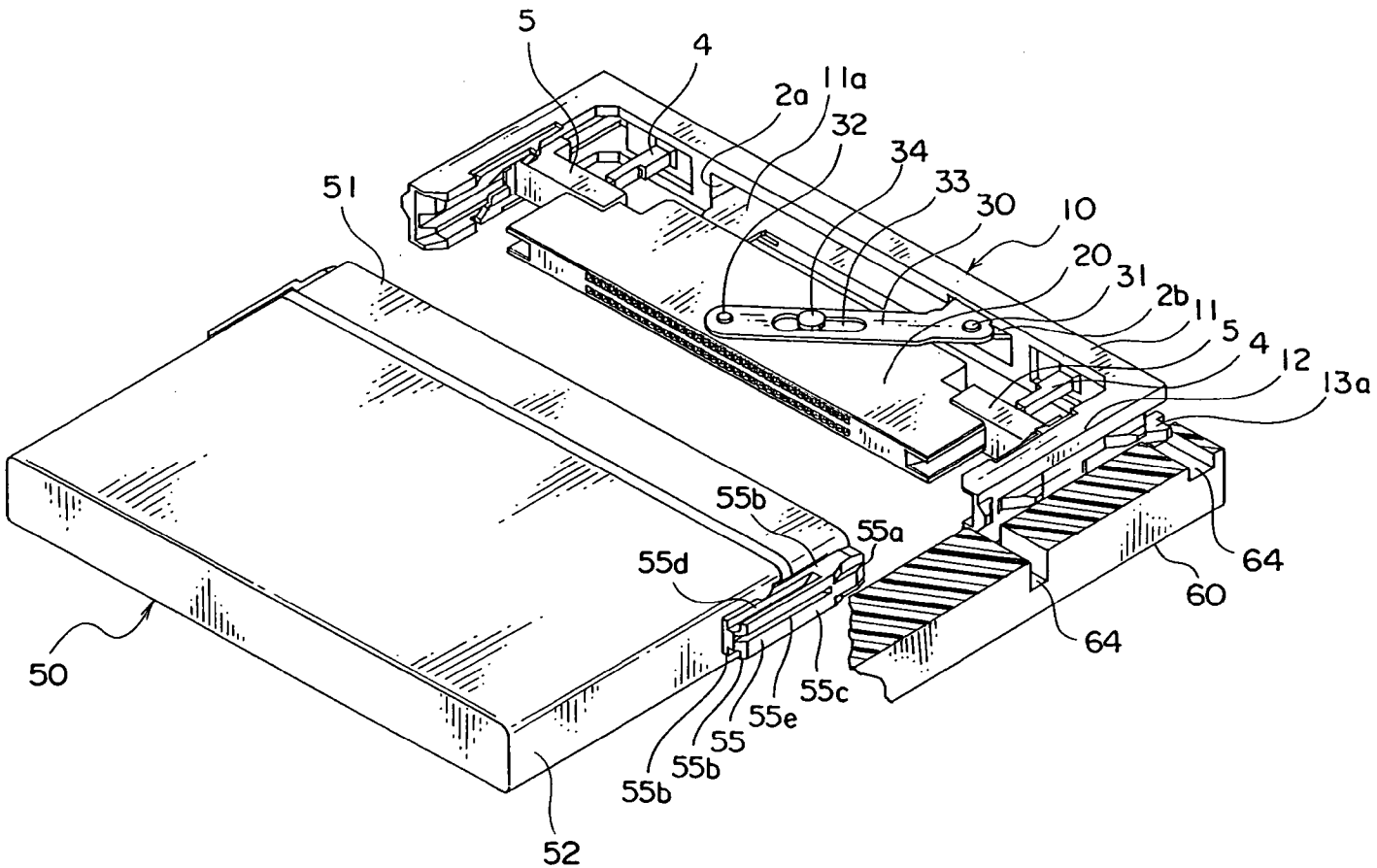
FIG. 19 is an exploded perspective view of a floating connector according to a second embodiment of this invention.
Figure 20:
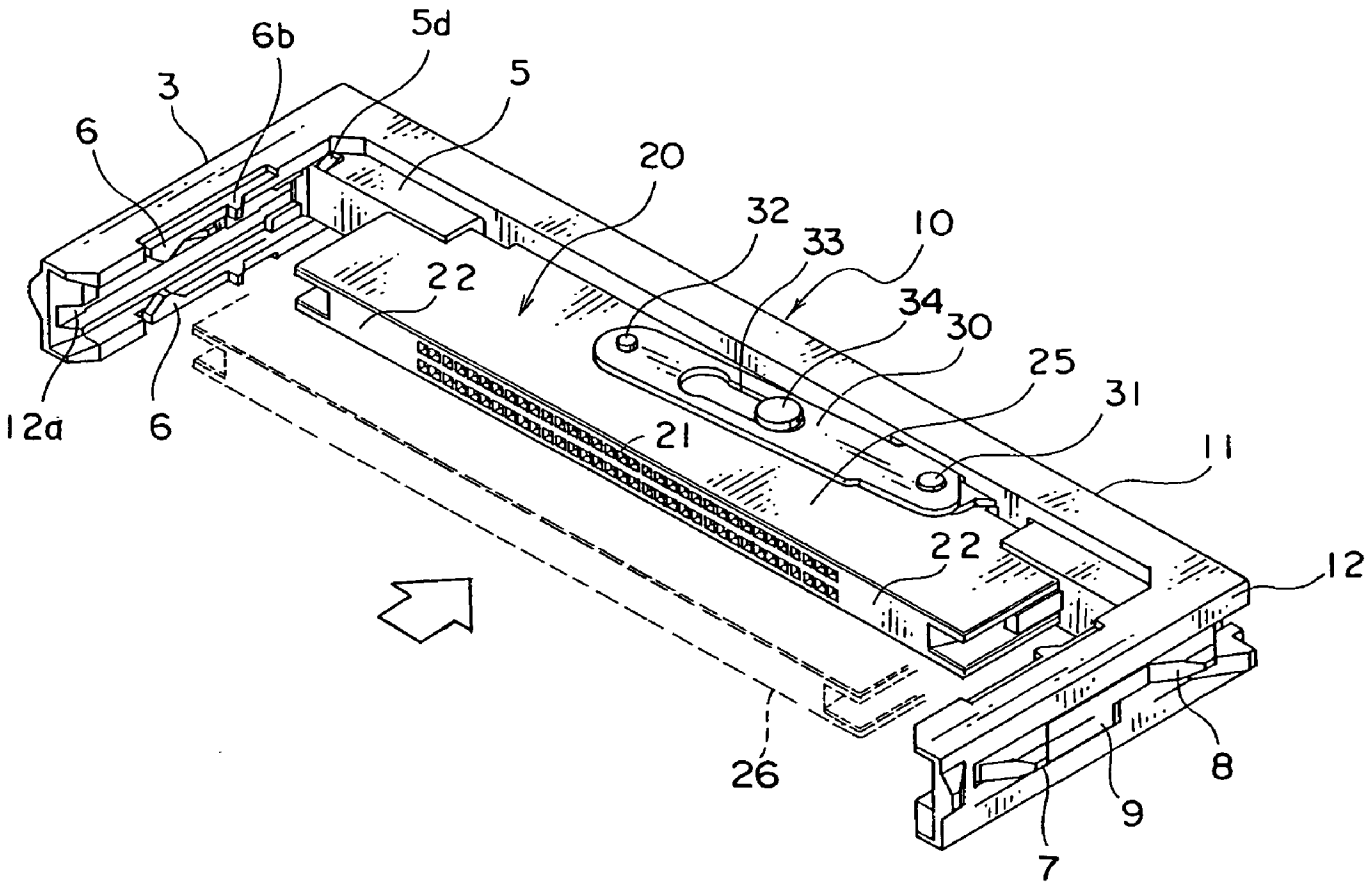
FIG. 20 is a perspective view of a sub module of the floating connector illustrated in FIG. 19.

Referring to FIGS. 19 and 20, a sub module 10 is disposed in a housing 60 of an ECU-BOX. A mating electronic apparatus 50 is disposed in an ECU case 52 receiving an ECU board in the manner similar to that illustrated in FIG. 7. A male connector 51 having a pair of guide portions 55 on its opposite sides is disposed at one end of the ECU board and seals one end of the ECU case 52.

Like in the first embodiment, the sub module 10 has a base portion 11 and a pair of guide portions 12 on opposite sides of the base portion 11. At a rear end of a female housing 25, a plurality of cables are connected through a hole 11*a* formed on the base portion 11 although not shown in the figure.

A lever 30 connects a front end of the base portion 11 and an upper surface of a female connector 20. The lever 30 has one end fixed to the female connector 20 by a rotary shaft pin 31 and the other end as a free end provided with a pin 32. The lever 30 has a long hole 33 engaged with a guide pin 34 formed on the upper surface of the female connector 20. Thus, the movement of the lever 30 is guided by the guide pin 34. The lever 30 serves to adjust a moving distance and a moving position of the female housing 25 in a fitting direction and has an effect of reducing an inserting force and a removing force into and from the female housing 25 by the principle of leverage. Therefore, the lever 30 is called a toggle mechanism.

Inside the guide portions 12 of the sub module 10, T-shaped sliding portions 5 extend outward from the female housing 25 towards the guide portions 12. Inside the guide portions 12 and outside the sliding portions 5, one and the other pairs of fitting direction floating spring portions 6 are formed, respectively. In each pair, the fitting direction floating spring portions 6 are formed upside and downside and faced to each other. The fitting direction floating spring portions 6 in each pair have first protruding portions 6*a* protruding downward and upward to face each other and second protruding portions 6*b* protruding inward.

Figure 21:
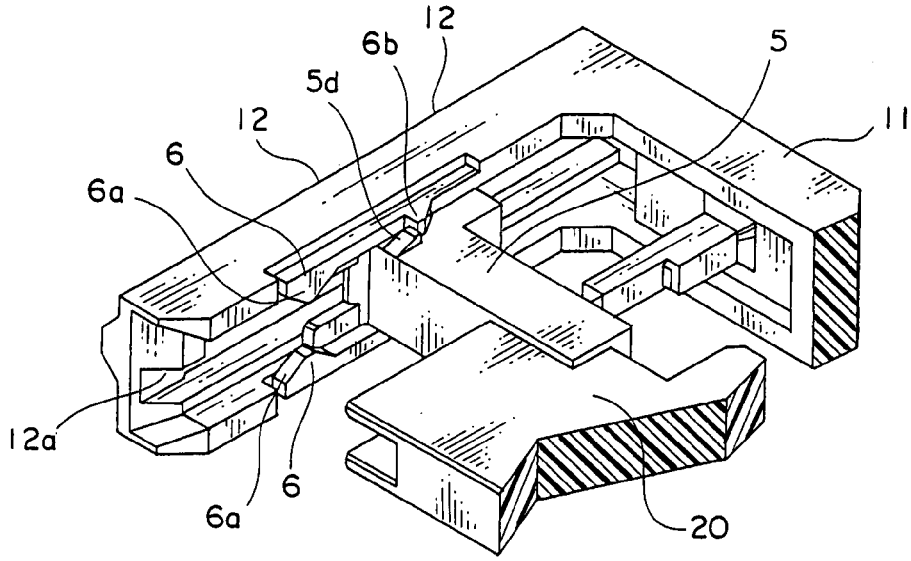
FIG. 21 is a partial perspective view showing a state before fitting.

Referring to FIG. 21, before fitting, triangular protrusions 5*d* formed at opposite ends of the sliding portions 5 on opposite sides of the female connector 20 are engaged with the second protruding portions 6*b* of the fitting direction floating spring portions 6 to inhibit rearward movement of the female connector 20 in the fitting direction and to prevent displacement from a standby position.

Figure 22:
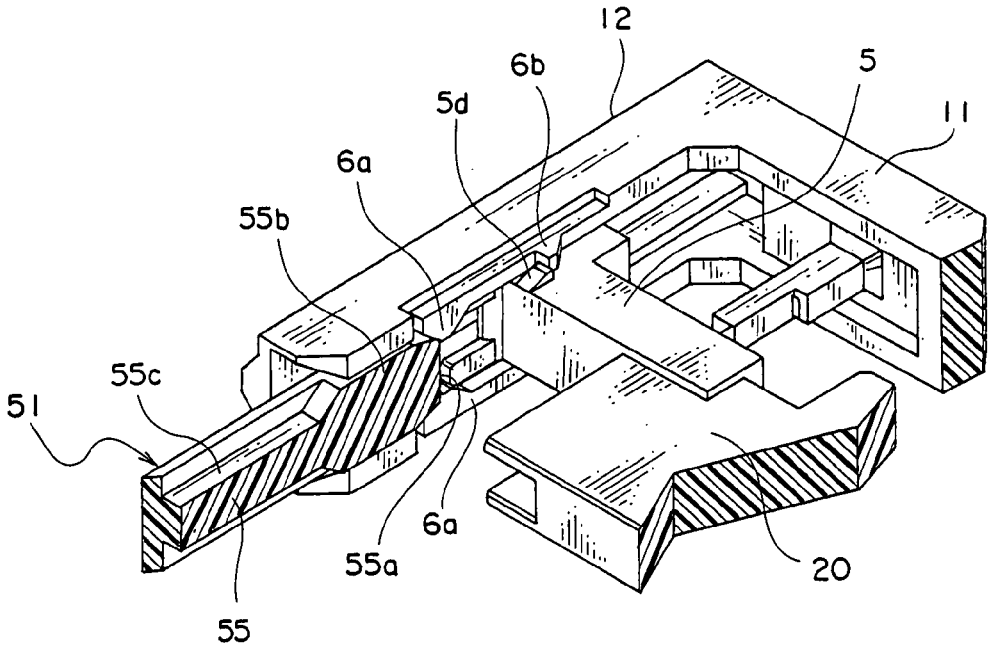
FIG. 22 is a partial perspective view showing an unlocked state.

Referring to FIG. 22, the male connector 51 is provided with the guide portions 55 formed on opposite sides thereof and having ends 55*a* and platform portions 55*b* higher than the ends 55*a*. When the male connector 51 and the female connector 20 are located at a predetermined distance from each other, slant surfaces between the ends 55*a* and the platform portions 55*b* are brought into contact with the first protruding portions 6*a* of the fitting direction floating spring portions 6. With the progress of fitting, the slant surfaces widens ends of the fitting direction floating spring portions 6. Then, the second protruding portions 6*b* are disengaged from the protruding portions 5*d* of the sliding portions 5 so that the female connector 20 is released from a locked state.

Figure 23:
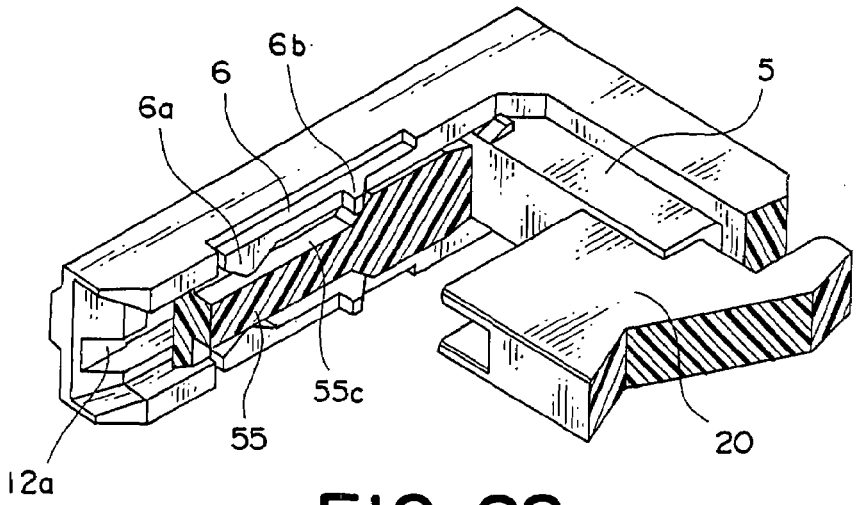
FIG. 23 is a partial perspective view showing a state after fitting.

Referring to FIG. 23, with the further progress of fitting, the first protruding portions 6*a* sink into groove portions 55*c* of the guide portions 55 of the male connector 51 inward in a vertical direction so that the fitting direction floating spring portions 6 are recovered into an undeformed state.

Figure 24:
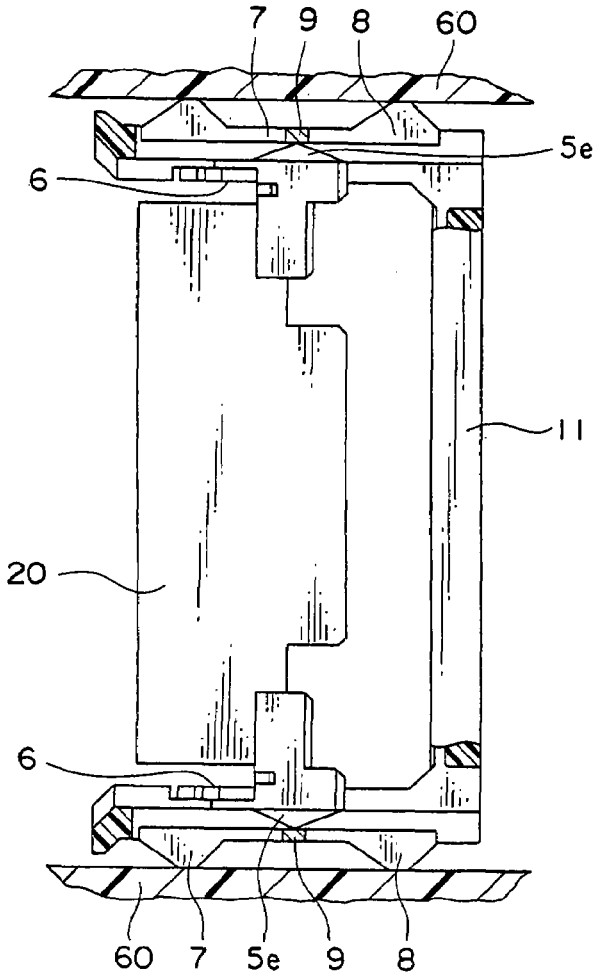
FIG. 24 is a partial plan view, partially in section, showing the state after fitting.

Referring to FIG. 24, the female connector 20 is supported in the housing 60 of the ECU-BOX by the fitting direction floating spring portions 6.

Figure 25:
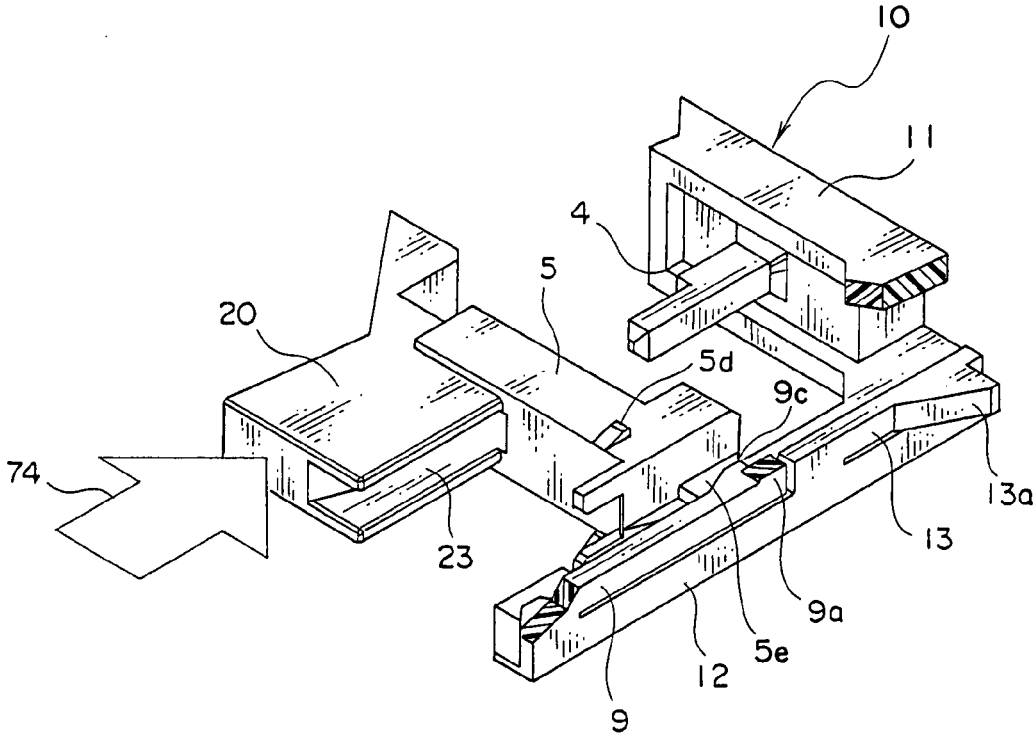
FIG. 25 is a partial perspective view for describing a method of incorporating a female connector, showing a state during assembling.
Figure 26:
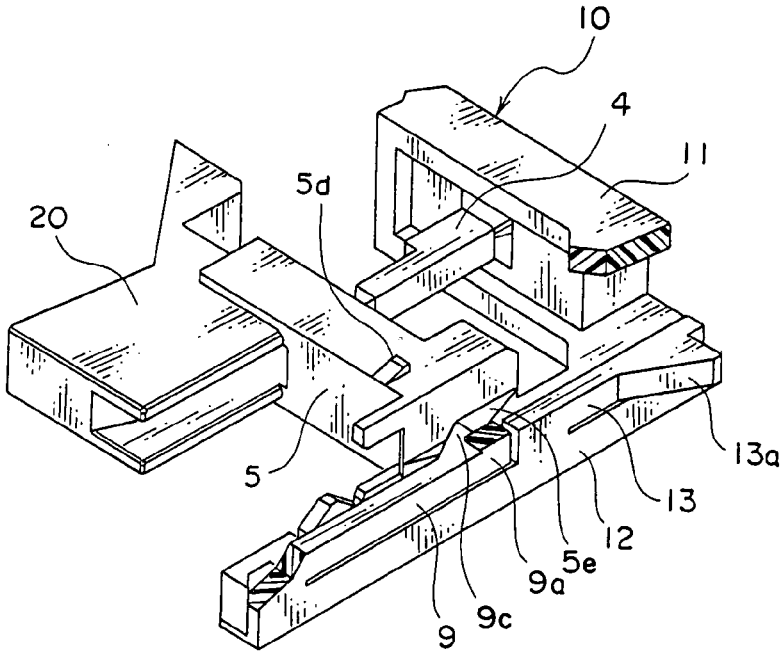
FIG. 26 is a partial perspective view similar to FIG. 25, showing a state after completion of incorporating.

Referring to FIG. 25, the guide portions 12 are provided with supporting springs 9 for displacing support portions of the fitting direction floating spring portions 6. When the female connector 20 is inserted into the sub module 10 in a direction depicted by an arrow 74, protruding portions 9*c* formed on the supporting springs 9 to protrude inward are engaged with step portions of protruding portions 5*e* protruding outside the sliding portions 5. Therefore, as illustrated in FIG. 26, the female connector 20 is locked by the sliding portions 5 to be prevented from being released.

Figure 27:
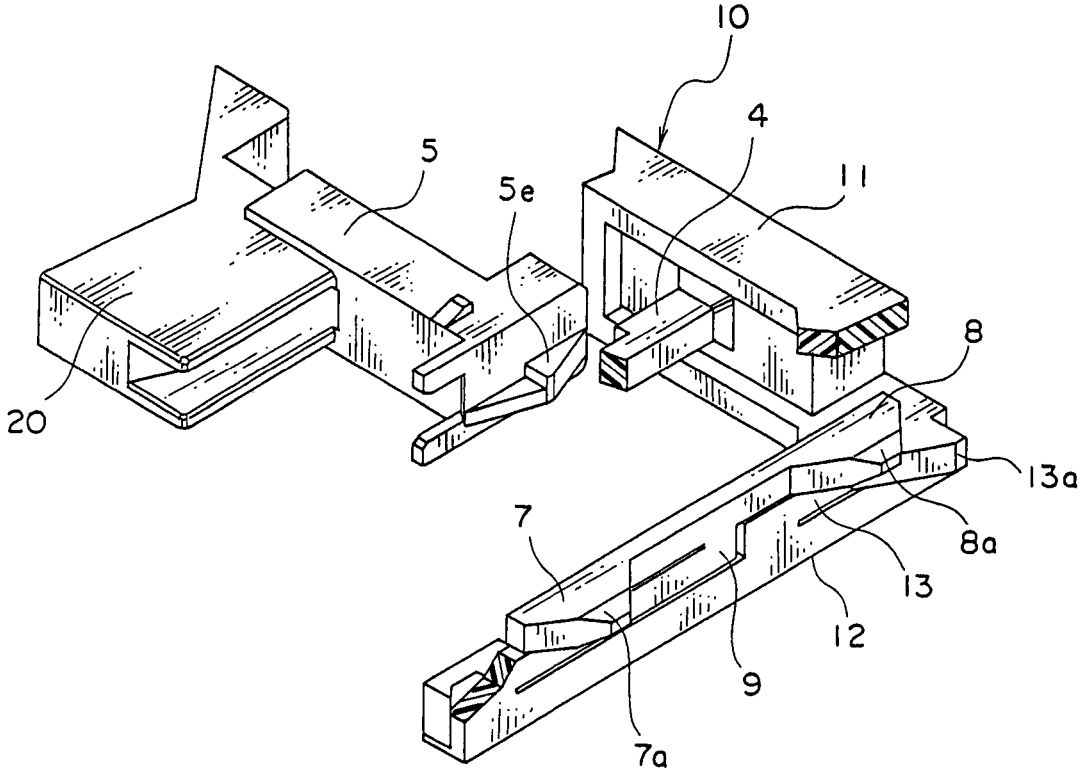
FIG. 27 is a partial perspective view showing a floating structure.

As illustrated in FIG. 27, each of the guide portions 12 of the sub module 10 is provided with first and second horizontal/vertical direction floating spring portions 7 and 8 having ends connected to each other to form a series of hard rod-like springs. The first and the second horizontal/vertical direction floating spring portions 7 and 8 are provided with first and second protruding portions 7*a* and 8*a* formed outside, respectively. Further, the guide portion 12 is provided with the supporting spring 9 having one end connected to a connecting portion of the above-mentioned ends of the first and the second horizontal/vertical direction floating spring portions 7 and 8 and arranged adjacent to the first horizontal/vertical direction floating spring portion 7.

Below the second horizontal/vertical direction floating spring portion 8, the locking portions 13 are formed as fixing springs for fixation to the housing 60. Each of the locking portions 13 has a protruding portion 13*b* formed at its end and extends forward to a base portion formed around a center portion of the guide portion 12.

Figure 28:
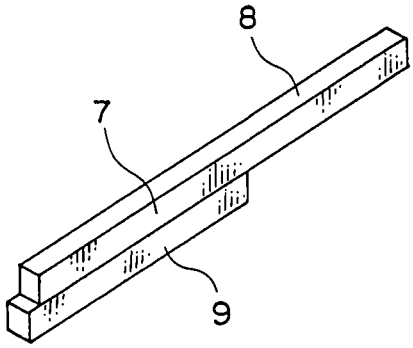
FIG. 28 is a schematic perspective view of a floating spring.

As shown in FIG. 28, each of the first and the second horizontal/vertical direction floating spring portions 7 and 8 may be formed into a simple rod-like shape.

Figure 29:
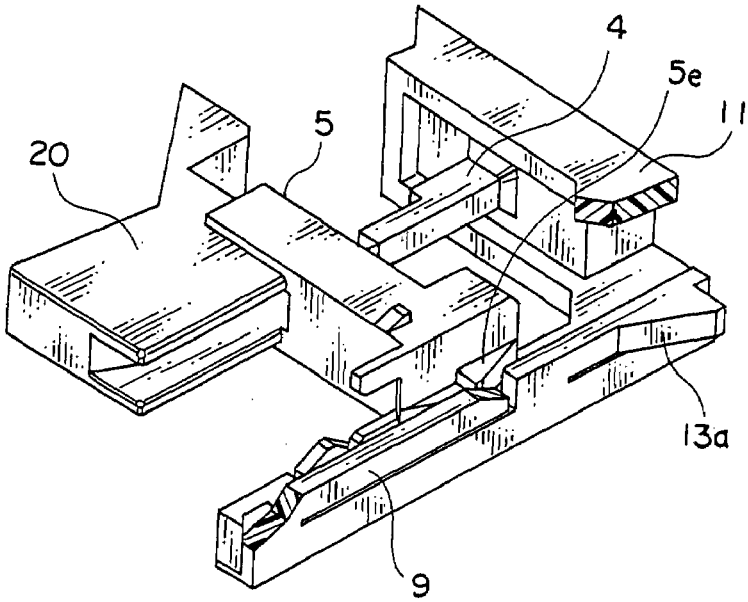
FIG. 29 is a partial perspective view showing the floating structure in a state before fitting.

Referring to FIG. 29, in the state before fitting, the protruding portion 5*e* of each guide portion 5 of the female connector 20 supports a supporting portion 9*a* of the supporting spring 9 illustrated in FIGS. 25 and 26. In this state, floating movement under the spring reactive force is allowed as illustrated in FIG. 24.

Figure 30:
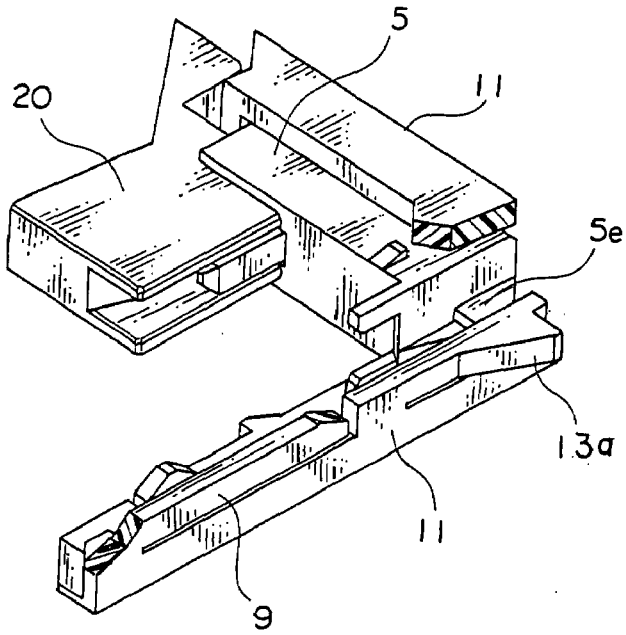
FIG. 30 is a view similar to FIG. 29 in a state after fitting.

Referring to FIG. 30, after fitting and when the female connector 20 is retreated or moved rearward, contact between the protruding portion 5*e* of each sliding portion 5 and the supporting spring 9 is released. Therefore, floating movement is allowed in the widthwise direction of the connector without the reactive force.

Next, description will be made of a removing operation of the floating connector described in conjunction with FIGS. 19 to 30 after fitting.

Figure 31:
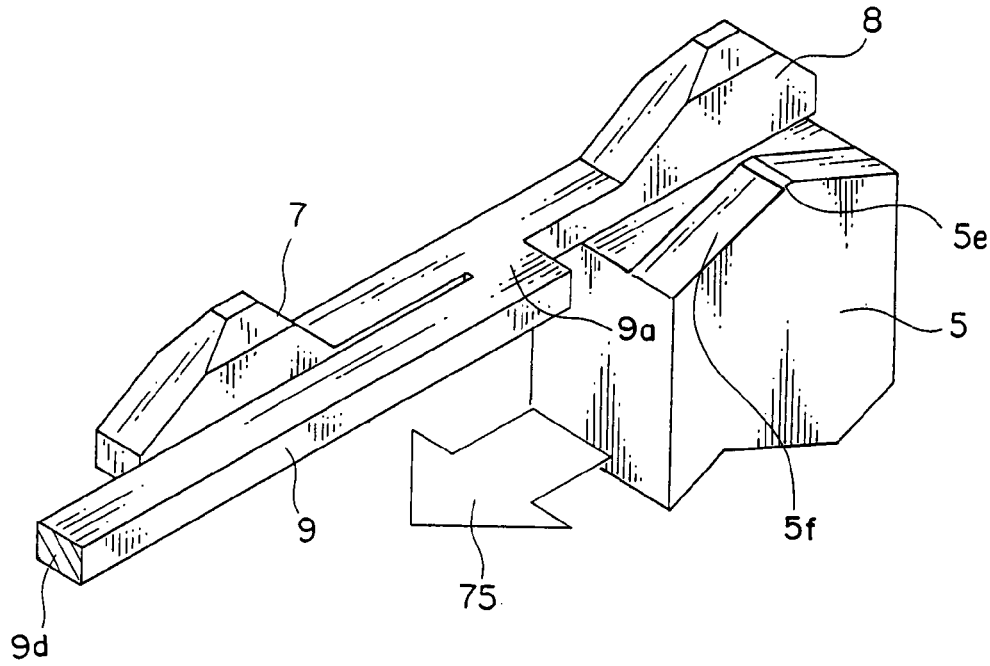
FIG. 31 is a partial perspective view showing a state before a male connector and the female connector are released from each other.

Referring to FIG. 31 in addition, upon removal, the protruding portions 5*e* of the sliding portions 5 on opposite sides of the female connector 20 fitted to the male connector 51 push the first and the second horizontal/vertical direction floating spring portions 7 and 8 upward via the supporting portions 9*a* of the supporting springs 9 by the use of slant surfaces 5*f*.

Figure 32:
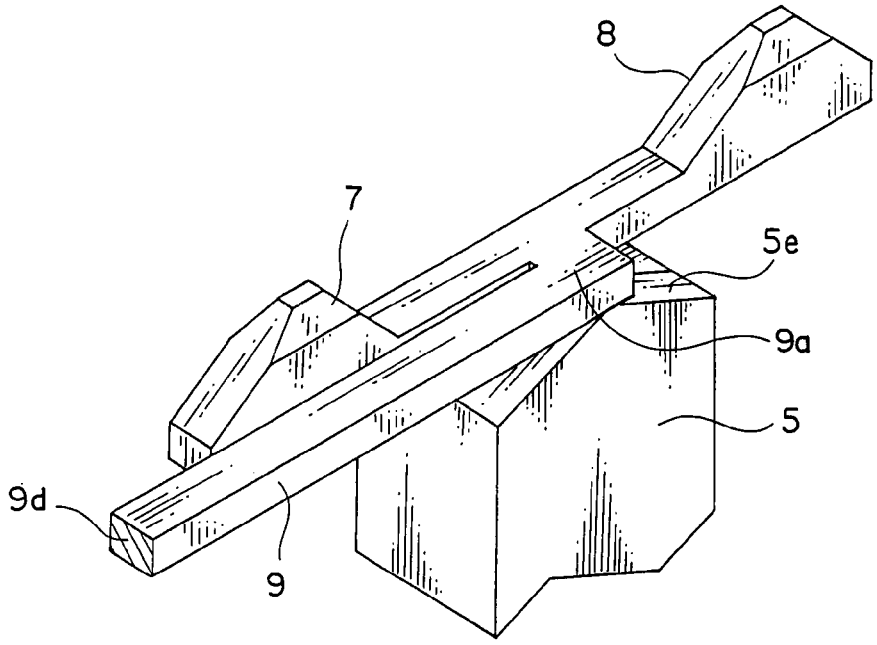
FIG. 32 is a partial perspective view showing a state after the male connector and the female connector are released from each other.

Referring to FIG. 32, after removal, starting points of the supporting springs 9 of the first and the second horizontal/vertical direction floating spring portions 7 and 8 climb up the protruding portions 5*e* of the sliding portions 5. A reference numeral 9*d* represents a base portion of each supporting spring 9. In this state, floating movement under the spring reactive force is allowed.

Figure 33:
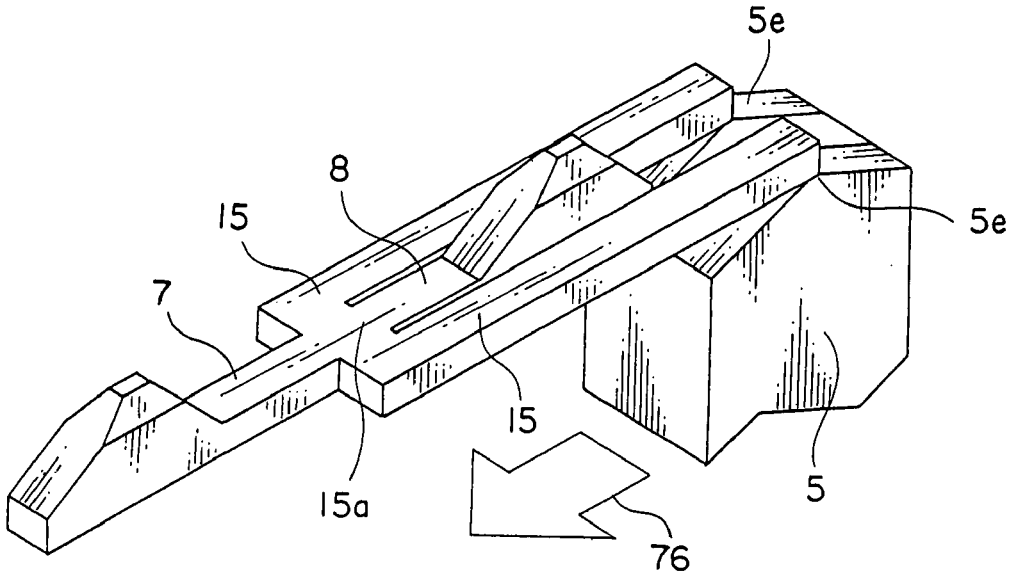
FIG. 33 is a partial perspective view of a modification of the floating connector according to the second embodiment of this invention in a state where a male connector and a female connector are released from each other.
Figure 34:
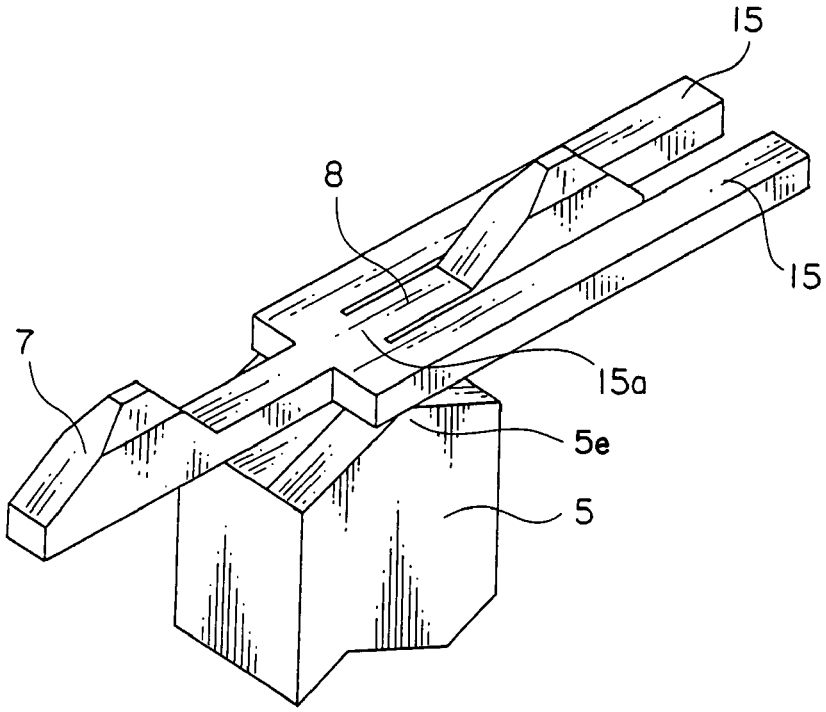
FIG. 34 is a partial perspective view similar to FIG. 33 in a state where the male connector and the female connector are released from each other.

Referring to FIGS. 33 and 34, description will be made of a modification of the floating connector according to a second embodiment of this invention. Similar parts are designated by like reference numerals.

Referring to FIG. 33, the floating connector has a pair of supporting springs 15 to sandwich the first and the second horizontal/vertical direction floating spring portions 7 and 8. The supporting springs 15 extend rearward together with the second horizontal/vertical direction floating spring portion 8.

Referring to FIG. 34, the male connector and the female connector are released from each other. The supporting springs 15 are symmetrical with each other as shown in the figure. With this structure, it is possible to suppress twisting of the first and the second horizontal/vertical direction floating spring portions 7 and 8. The supporting springs 15 of the first and the second horizontal/vertical direction floating spring portions 7 and 8 are always placed on the protruding portion 5*e* of the sliding portion 5 of the female connector. Therefore, it is possible to prevent breakage of the first and the second horizontal/vertical direction floating spring portions 7 and 8 due to undesired sticking.

While the present invention has thus far been described in connection with a few embodiments thereof, it will readily be possible for those skilled in the art to put this invention into practice in various other manners. For example, although a pair of the floating spring portions are formed on each of a pair of the guide portions in the foregoing, one floating spring portion may be formed on the guide portion and the floating spring portion or portions may be formed on only one of the guide portions. In the foregoing, the floating spring portions are integrally formed with the guide portion made of resin. However, the floating spring portions may be a separate member made of metal or the like and fixed to the guide portion.

What is claimed is:

1. A connector to be coupled to a housing and for coupling a mating connector in a predetermined direction, the connector comprising:

a sub module to be held by the housing; and a connector element held by the sub module to be slidable in the predetermined direction;

the sub module comprising:

a floating spring portion; and at least one guide portion connected to the floating spring portion for guiding the mating connector in the predetermined direction;

the floating spring portion comprising:

a contacting portion for being brought into contact with the housing; and an operated portion connected to the contacting portion and responsive to movement of the mating connector in the predetermined direction for separating the contacting portion from the housing, wherein the sub module is capable of floating in each of two directions which are perpendicular to the predetermined direction and to each other.

2. The connector according to claim 1, wherein the floating spring portion is formed integral with the guide portion.

3. The connector according to claim 1, wherein the sub module comprises a locking mechanism for holding the housing so that the housing is movable by a predetermined distance when the connector is not fitted to the mating connector, the locking mechanism being unlocked by the mating connector so that the housing is pushed by the mating connector to be moved to a fitting completion position when the connector is fitted to the mating connector.

4. The connector according to claim 1, wherein the floating spring portion further comprises:

a support portion connected to the guide portion;

a first floating spring portion extending from the support portion towards a fitting side with the mating connector in the predetermined direction; and a second floating spring portion extending from the support portion towards an opposite side opposite to the fitting side;

the contacting portion being provided to each of the first and the second floating spring portions.

5. The connector according to claim 4, wherein the first and the second floating spring portions are formed integral with the guide portion.

6. The connector according to claim 4, wherein the first and the second floating spring portions operate with a time interval therebetween in response to movement of the mating connector in the predetermined direction when the connector is coupled to the mating connector.

7. The connector according to claim 6, wherein the time interval is determined so that the contacting portion of the second floating spring portion separates from the housing after the contacting portion of the first floating spring portion separated from the housing.

8. The connector according to claim 7, wherein the contacting portions of both of the first and the second floating spring portions separate from the housing when the connector completely fitted to the mating connector.

* * * * *